United States Patent [19]

Reyes et al.

[11] Patent Number: 4,613,346

[45] Date of Patent: Sep. 23, 1986

[54] ENERGY CONTROL FOR ELECTROSTATIC PRECIPITATOR

[75] Inventors: Victor Reyes, Copenhagen; Eigil Kristensen, Ballerup, both of Denmark

[73] Assignee: F. L. Smidth & Co., Denmark

[21] Appl. No.: 781,195

[22] Filed: Sep. 25, 1985

Related U.S. Application Data

[63] Continuation of Ser. No. 520,809, Aug. 5, 1983, abandoned.

[30] Foreign Application Priority Data

Aug. 9, 1982 [DK] Denmark ..... 3553/82

[51] Int. Cl.[4] ..... B03C 3/68

[52] U.S. Cl. ..... 55/4; 55/105

[58] Field of Search ..... 55/2, 4, 105

[56] References Cited

U.S. PATENT DOCUMENTS 4,284,417 8/1981 Reese et al. ..... 55/2
4,410,849 10/1983 Ando ..... 55/105 X
4,413,225 11/1983 Donig et al. ..... 55/105 X
4,432,061 2/1984 Herklotz et al. ..... 55/105 X
4,445,911 5/1984 Lind ..... 55/2

FOREIGN PATENT DOCUMENTS 30321 6/1981 European Pat. Off. ..... 55/105
0044488 1/1982 European Pat. Off. ..... 55/105
0054378 6/1982 European Pat. Off. .
0055525 7/1982 European Pat. Off. .

*Primary Examiner*—Kathleen J. Prunner
*Attorney, Agent, or Firm*—Brumbaugh, Graves, Donohue & Raymond

[57] ABSTRACT

To control an electrostatic precipitator towards minimum energy consumption at a given efficiency the dust content in the exit air of the precipitator is measured and the efficiency of the precipitator regulated upwardly or downwardly accordingly. Regulation is carried out in accordance with a selected one of a plurality of predefined stored strategies by a central unit which controls the parameters of the independent power supplies to the precipitator sections.

11 Claims, 1 Drawing Figure

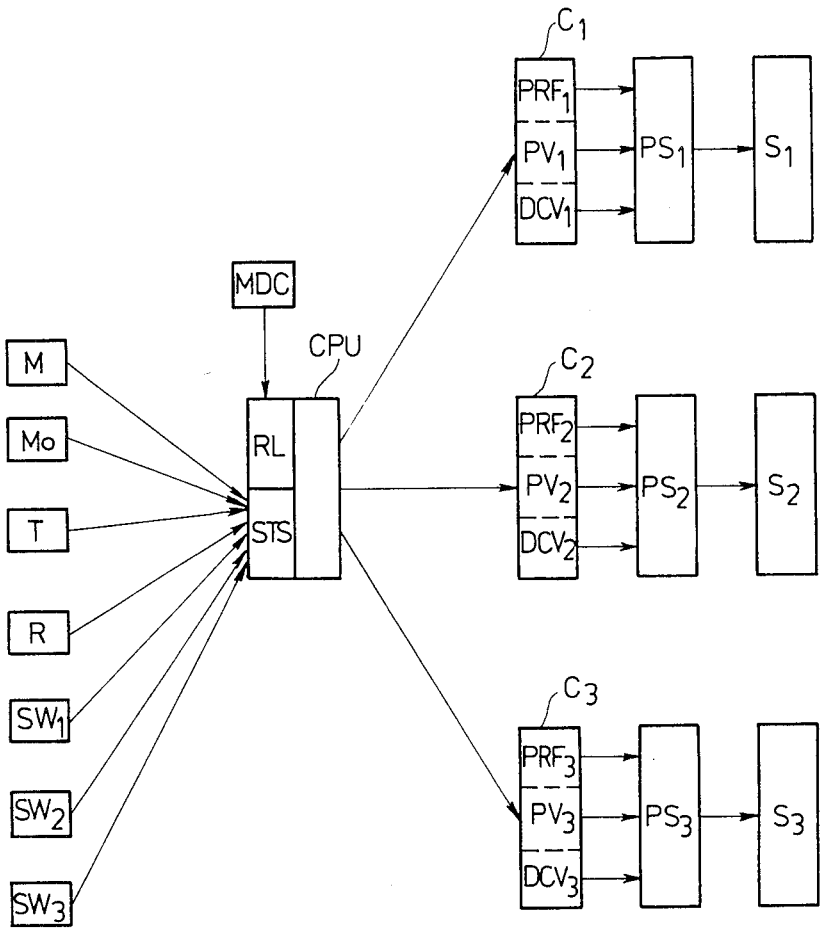
C1
PRF1
PV1
DCV1
PS1
S1
MDC
CPU
M
Mo
T
R
SW1
SW2
SW3
RL
STS
C2
PRF2
PV2
DCV2
PS2
S2
C3
PRF3
PV3
DCV3
PS3
S3

ENERGY CONTROL FOR ELECTROSTATIC PRECIPITATOR

This application is a continuation of application Ser. No. 520,809, filed on Aug. 5, 1983 and now abandoned.

The invention relates to a method of controlling an electrostatic precipitator which has one or more precipitator sections, the or at least one section being charged from an independent power supply for supplying a pulse superimposed DC-voltage, and more particularly to a method of controlling the entire electrostatic precipitator towards minimum energy consumption at a certain efficiency.

From European Patent Application No. 0054 378 and European Patent Application No. 0055 525 it is known to control the power supply of a pulse energized electrostatic precipitator towards maximum precipitator efficiency. These means are exclusively aimed to make the precipitator as efficient as possible without considering whether the high efficiency is necessary in connection with the purification in question, i.e. without taking into consideration questions relating to general business economics.

When it is a matter of purifying smoke and the like exit gases, the required degree of purification necessary is often determined by law, and consequently it is an object of the invention to devise a method of controlling the operation parameters of the power supply such that the precipitator consumes minimum energy at a certain required efficiency, e.g. the efficiency determined by legal requirements or by the somewhat improved purification aimed at for practical reasons.

From U.S. Pat. No. 4,284,417 it is known to control the energy supplied to a DC-voltage energized electrostatic precipitator on the basis of a measurement of the translucence of the exit gas leaving the precipitator, such that the energy supplied is regulated upwards if a decreased exit gas translucence indicates that the smoke contains more impurities than indicated by a set value and conversely is regulated downwards if an increased translucence indicates that the purification is more efficient than necessary.

Whereas it is only possible in such a DC-voltage energized electrostatic precipitator to control the energy supplied by controlling one parameter, viz. the voltage to which the condenser formed by the electrodes of the precipitator is charged, the power supply for a pulse energized precipitator has more variable parameters that are important for the energy consumption, as the latter varies both with the DC-voltage over the electrodes and with the pulse amplitude, duration, form and repetition frequency.

From West German Patent Application No. 30 27 172 it is known to aim at minimizing the energy consumed in a pulse energized electrostatic precipitator by iteratively altering the DC-voltage and/or the pulse parameters so as to reduce the energy consumption, the iterative energy reduction being continued for as long as an efficient purification of the polluted gas passed through the precipitator can be detected.

Such an iteration process is time-consuming, especially if the precipitator is built with plural sections with separate power supplies having operation parameters which are each to be iterated towards values giving the desired efficiency with the lowest possible energy consumption over the entire precipitator.

During this time-consuming process the operation conditions of the precipitator might change before the aimed-at minimum hs been reached. Further, the iteration process involves the danger of being caught in a local minimum, i.e. a parameter value set in which every alteration of the parameters causes an increasing energy consumption, but in which the energy consumption appertaining to the parameter value set in question is not the lowest possible one at the efficiency fixed.

Consequently, it is an object of the invention to devise a method of controlling the operation parameters of a pulse energized electrostatic precipitator so as to achieve quick and optimum minimization of the energy consumed at a certain efficiency.

According to the present invention in an electrostatic precipitator consisting of at least one precipitator section which is charged from a respective independent power supply for supplying a pulse superimposed direct voltage to the section, a method of controlling the entire electrostatic pecipitator towards minimum energy consumption at a certain efficiency comprises measuring the dust content in the exit air of sid precipitator, and regulating the efficiency of said precipitator upwardly or downwardly dependent on whether said measured dust content is above or below a preset value, by controlling parameters of the at least one power supply within set limits, said control being made from a central unit and defined by a selected one of a plurality of predefined stored control strategies. Where the precipitator has a plurality of sections all of the sections are controlled from said central unit.

The strategies determine in which precipitator sections and in what order the individual power supply parameters are regulated, whereas the dust content in the exit gas of the precipitator determines how far and in which direction the course of regulation determined by the strategy must be followed.

The stored strategies are based on the knowledge of the operating properties of electrostatic precipitators as a whole, and of the precipitator in question in particular. Through experiments it can be decided which strategy ought to be followed under different operation conditions and the central control unit can be provided with an access through which the choice of strategy can be influenced manually or automatically when changed operation conditions are detected.

When the dust content in the exit gas of the precipitator is below the value for which the precipitator is set, the efficiency of the precipitator is regulated down by regulating the power supply parameter selected according to the strategy chosen. When this parameter has been regulated to one of the limits of the parameter range or to a limit at which the strategy dictates that it is more advantageous to regulate on another power supply parameter, the central unit sees to it that the regulation is referred to the parameter being the most advantageous and so on. Conversely, when the dust content in the exit gas becomes too high, the efficiency is increased by executing the parameter order laid down in the strategy in reverse order. When a precipitator and its possible operation conditions are known, it is thus possible to make and store strategies at all times ensuring that the regulation takes place on the power supply parameter giving, when upgrading (i.e. regulating the electrostatic precipitator to a higher dust precipitation performance), the largest increase in efficiency as compared with the increase in the energy consumption of the precipitator, and conversely, when down-regulating, the smallest decrease in efficiency as compared with the energy saving.

Further, the measured deviation of the dust content from that desired, determines the speed at which the regulation takes place and an uncomplicated strategy can be stored in the control unit, which quickly adjusts the precipitator to maximum efficiency if the dust content is dangerously close to exceeding the allowed value.

The precipitator sections, each having their separate power supply which independently controls its operation parameters towards limits existing in practice or being preset, may be coupled in series and/or in parallel, and the regulation of the operation parameters made by the control unit can consist of a regulation of the mentioned preset limits, whereas the individual power supplies continue to take care themselves (i.e. each individual power supply has its own independent control controlling it towards optimum efficiency within the limits set by the control unit or by practical restrictions such as the maximum rating of the power supply or the occurrence of spark-overs) that they are controlled towards optimum efficiency within these certain limits. In accordance with the strategy stored in the control section, the power supply of the individual precipitator sections can be controlled differently by which is achieved a so-called profiling of the precipitator.

According to a preferred strategy the following down-regulation order is used when an unnecessarily efficient purification is detected.

a. The pulse repetition frequency (PRF) is regulated down.
b. When PRF reaches a set limit the pulse voltage (PV) is regulated down.
c. WHen the pulse voltage (PV) reaches a set limit the DC-voltage (DCV) is regulated down.

For use when filtering of high resistivity dust a strategy is preferred according to which:

a. The DC-voltage (DCV) is regulated down.
b. When the DC-voltage (DCV) reaches a set value the PRF is regulated down.
c. When PRF reaches a set limit the pulse voltage (PV) is regulated down.
d. When the pulse voltage (PV) reaches a set limit the DC-voltage (DCV) is regulated further down.

Furthermore, nothing hinders the use of more complicated strategies in which different parameters in changing order are regulated down step by step so that a parameter is regulated down somewhat, but not to its lowermost limit after which another parameter is regulated somewhat down whereupon a further downwards-regulation takes place of the first parameter etc., downwards-regulation always being made on the parameter giving the smallest reduction in the efficiency as compared with the reduction in the energy consumption of the precipitator.

The order of upwards-regulation will be the reverse of the order of downwards-regulation used.

In a precipitator consisting of plural sections the strategy may comprise a description of how and in which order the individual sections are to be regulated upwards or downwards. One single strategy is to the effect that sections working in parallel are regulated upwards simultaneously and in the same way, whereas sections coupled in series are regulated downwards in such a way that the regulation takes place section-wise, implying that the individual sections can be totally coupled off or be brought to operate as DC-energized sections. Further, non-pulse operated DC-sections can always form part of a precipitator, and also the efficiency of these sections can be regulated in accordance with the invention.

The control unit, in which the decision is made about the order in which the regulation of the parameters of the individual power supplies shall take place, can appropriately be in the form of a computer (micro-computer) in which the strategies are stored which determine the order of and within which limits the regulating shall take place, and in which the choice of strategy is made on the basis of orders given by manual adjustment and/or by received measuring values from one or more constantly monitored process parameters or operation parameters for the precipitator, such as coupling on or off of a process stage, dust resistivity, temperature, moisture etc.

The invention will now be further described with reference to the accompanying block diagram illustrating components of a system for carrying out the method of the invention.

An electrostatic precipitator comprises a plurality of sections S1, S2, S3 each of which has a respective independent power supply PS1, PS2, PS3 and a respective control unit C1, C2, C3 which operates to adjust the respective pulse repetition frequency (PRF), pulse voltage level (PV) and DC-voltage level (DCV).

To achieve efficient control of the precipitator a central control unit CPU is used to, in turn, control the units C1,C2,C3, in dependence upon a predetermined stored control strategy and the measured dust content of the exit gases from the plant in which the precipitator is located. The measured dust content, MDC, is input to the CPU to determine the regulation level to which the efficiency of the precipitator is to be adjusted, thus controlling the direction of regulation and its extent.

The selection of a suitable strategy from amongst a plurality of stored strategies can be achieved in a number of ways, by way of manual input to the CPU to a strategy selection unit STS of by similar input from parameter sensing devices, sensing, for example, the moisture level, temperature or resistance of the exit gases from the plant and/or the on/off states of process steps in the plant dedusted by the precipitator, e.g. in or out couplings of mills, conditioners and fuel feeders, these inputs being indicated by respective units M, Mo, T, R, SW1,SW2, and SW3.

It will be appreciated that various alternatives or additional parameters can be used to control the selection from amongst the predefined strategies and that the strategies themselves can be modified from the manual input M if precipitator conditions or requirements are changed.

We claim:

1. A method of controlling an electrostatic precipitator for reducing the dust content of exit gas from a plant which includes one or more precipitator sections, said method comprising charging each of said sections from a separate independent power supply for supplying a controllable high DC-voltage thereto, superimposing on said DC-voltage controllable high voltage pulses at a controllable repetition frequency, controlling the entire electrostatic precipitator towards minimum energy consumption at a certain set dedusting efficiency, by measuring the dust content in the exit gas from the entire precipitator and regulating the dedusting efficiency of the entire precipitator upwardly or downwardly depending on whether said measured dust content is above or below a preset value, the regulation being made through controlling the running parameters of one or more of the power supplies within set limits according to a control strategy selected among a plurality of predefined stored control strategies, each said control strategy comprising a sequence of instructions as to in what order, in which way and within which limits the DC-voltage, the pulse voltage and the pulse frequency of the respective power supplies of said precipitator sections are regulated, said dust content measurement determining if the instructions should be followed in forward or in reverse order, and how far the sequence of instructions should be followed.

2. The method of claim 1, in which said strategy selection takes place manually.

3. The method of claim 1 in which said strategy selection is influenced by process parameters of the plant the exit gas of which the precipitator dedusts.

4. The method of claim 1 in which said strategy selection is influenced by measured values of one or more continuously measured precipitator parameters.

5. The method of claim 1 in which the strategy for the down-regulation of the efficiency of the precipitator is arranged so that regulation is always effected on the power supply parameter giving the smallest reduction of the efficiency for a given energy saving.

6. The method of claim 1, in which the strategy for up-regulation of the efficiency of the precipitator is arranged so that regulation is always made on the power supply parameter giving the largest increase of the efficiency for a given increase in energy consumption.

7. The method of claim 1, in which one of the stored strategies when down-regulating efficiency comprises the following steps in turn:

a. down-regulation of the pulse repetition frequency to a set limit, b. down-regulation of the pulse voltage to a set limit, and c. down-regulation of the DC-voltage.

8. The method according to claim 7, characterized in that the steps determined by the strategy when up-regulating the efficiency are executed in reverse order to the steps when down-regulating efficiency.

9. The method of claim 1, in which one of the stored strategies when down-regulating the efficiency of the precipitator comprises the following steps in turn:

a. down-regulation of the DC-voltage to a set value, b. down-regulation of the pulse repetition frequency to a set limit, c. down-regulation of the pulse voltage to a set limit, and d. further down-regulation of the DC-voltage.

10. The method according to claim 9, characterized in that the steps determined by the strategy when up-regulating the efficiency are executed in reverse order to the steps when down-regulating efficiency.

11. The method of any of claims 1 to 9, wherein said control strategy is made from a central unit and defined by a selected one of a plurality of predefined stored control strategies.

* * * * *